United States Patent [19]

Engel et al.

[11] Patent Number: 4,977,657

[45] Date of Patent: Dec. 18, 1990

[54] METHOD OF PRODUCING A FRAGMENTATION JACKET

[75] Inventors: Walter Engel, Schwerzenbach; Franz Moser, Weisslingen; Hugo Sigrist, Hinwil, all of Switzerland

[73] Assignee: Werzeugmaschinenfabrik Oerlikon-Buhrle AG, Zurich, Switzerland

[21] Appl. No.: 413,090

[22] Filed: Sep. 27, 1989

[30] Foreign Application Priority Data

Oct. 27, 1988 [CH] Switzerland ..... 04005/88

[51] Int. Cl.[5] ..... B21K 21/06

[52] U.S. Cl. ..... 29/1.21; 29/1.23; 71/348; 102/493

[58] Field of Search ..... 29/1.1, 1.11, 1.2, 1.21, 29/1.22, 1.23; 72/348; 102/493

[56] References Cited

U.S. PATENT DOCUMENTS 3,137,057 6/1964 Martin ..... 72/348 X
3,590,451 7/1971 Dessart ..... 29/1.21
3,878,704 4/1975 Shea .
4,774,745 10/1988 Carter ..... 29/1.2 X

FOREIGN PATENT DOCUMENTS 8427780 5/1985 Fed. Rep. of Germany .
1167828 10/1969 United Kingdom .

*Primary Examiner*—Joseph M. Gorski
*Attorney, Agent, or Firm*—Sandler, Greenblum & Bernstein

[57] ABSTRACT

The fragmentation jacket of a projectile or shell should be prefragmentized in the simplest possible manner by means of reference fracture locations provided at the inner side or interior surface of the fragmentation jacket. For this purpose, the reference fracture locations are impressed into a disk, for example, by stamping. Subsequently, the thus formed disk is shaped by deep drawing to form a fragmentation jacket such that the reference fracture locations formed by grooves are located at the inner side or interior surface of a cup-shaped fragmentation jacket. This cup-shaped fragmentation jacket is filled with an explosive charge which is detonated by a base fuze or by a tip or point fuze.

12 Claims, 4 Drawing Sheets

METHOD OF PRODUCING A FRAGMENTATION JACKET

BACKGROUND OF THE INVENTION

The present invention broadly relates to ammunition rounds for weaponry and pertains, more specifically, to a new and improved method of producing a fragmentation or splintering jacket for a projectile or shell. In the interior of the fragmentation or splintering jacket there is located an explosive charge which is detonated by a fuze or detonator.

In its more particular aspects the present invention specifically relates to a new and improved method of producing a fragmentation or splintering jacket for a projectile or shell and which method encompasses producing a blank in the form of a disk, impressing into the disk reference fracture locations in the form of grooves and then subjecting the disk to a shaping operation in order to form the fragmentation or splintering jacket from the disk.

A warhead produced according to a known method of manufacturing splintering jackets is disclosed, for example, in German Petty Patent No. G 8,427,780.7, published May 15, 1985. A warhead housing serves to receive a hollow charge. A detonator or fuze is fastened to the warhead housing which is cup-shaped and fabricated by a shaping process, for instance deep drawing, from a metallic blank in the form of a round disk. A wire netting is rolled into the disk. This known method of fabricating a warhead of the fragmentation type is complicated and impractical for mass production purposes. Furthermore, the wire netting does not provide any particular advantages.

SUMMARY OF THE INVENTION

Therefore, with the foregoing in mind, it is a primary object of the present invention to provide a new and improved method of producing a fragmentation or splintering jacket and which method is not afflicted with the drawbacks and limitations of the prior art methods heretofore discussed.

Another significant object of the present invention is directed to providing a new and improved method of producing a fragmentation or splintering jacket and which method is inherently simple, and especially suitable for mass production of such fragmentation or splintering jackets.

Now in order to implement these and still further objects of the invention, which will become more readily apparent as the description proceeds, the method of producing a fragmentation or splintering jacket of the present development is manifested, among other things, by the features that the disk is produced to comprise portions having different thicknesses and defining a predeterminate configuration of the fragmentation or splintering jacket to be produced, prior to shaping the fragmentation or splintering jacket from such disk. BRIEF DESCRIPTION OF THE DRAWINGS The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

DETAILED DESCRIPTION OF THE PREFERRED EMBODIMENTS

Figure 1:
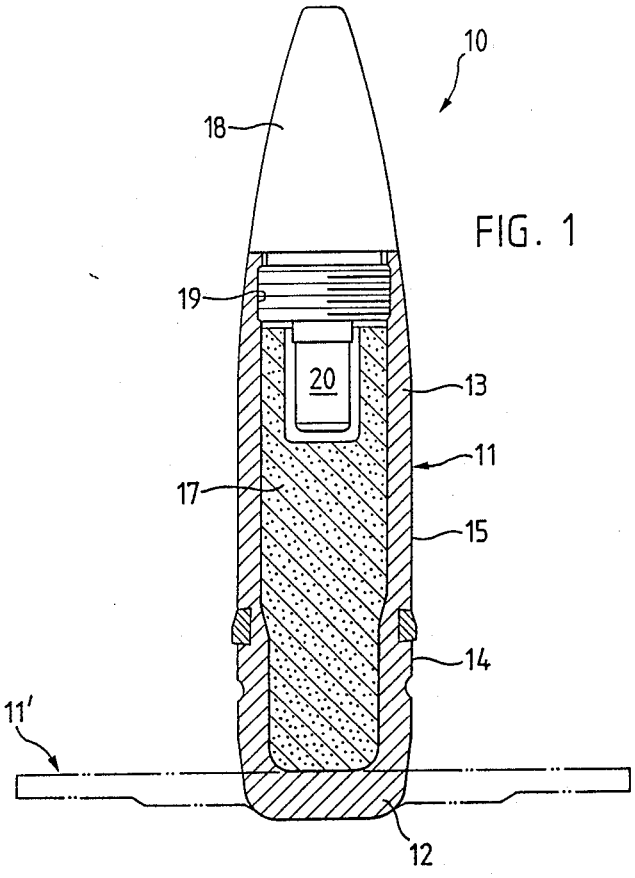
FIG. 1 shows a longitudinal sectional view through a projectile or shell comprising a tip or point or nose fuze or detonator and a fragmentation or splintering jacket produced according to a first exemplary embodiment of the inventive method.

Describing now the drawings, it is to be understood that to simplify the showing thereof, only enough of the projectile or shell has been illustrated therein as is needed to enable one skilled in the art to readily understand the underlying principles and concepts of this invention. Turning now specifically to FIG. 1 of the drawings, the steps of the inventive method are hereinafter described in connection with a projectile or shell 10 produced according to the inventive method and illustrated therein by way of example and not limitation.

The projectile or shell 10 comprises a cup-shaped fragmentation or splintering jacket 11. This fragmentation or splintering jacket 11 possesses a base or bottom 12 which is arranged at the rear or tail end of a sleeve-shaped projectile body 13. The rear or tail part or portion 14 of the sleeve-shaped projectile body 13 possesses a smaller internal or inner diameter than the front or head part or portion 15. In other words, the wall of the rear or tail part or portion 14 is thicker than the wall of the front or head part or portion 15 the base or bottom 12 is thicker than the wall of the rear or tail part or portion 14 of the sleeve-shaped projectile body 13.

Figure 3:
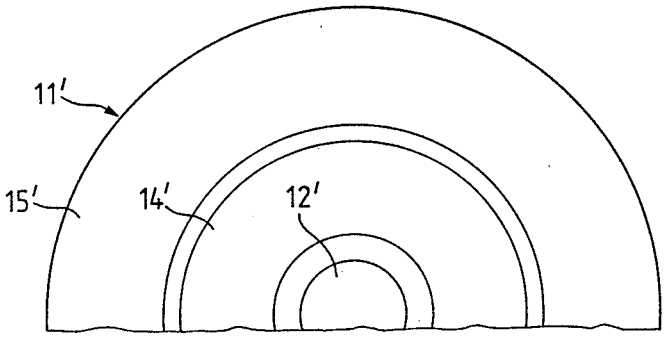
FIG. 3 is a fragmentary top plan view of the disk depicted in FIG. 2.
Figure 2:
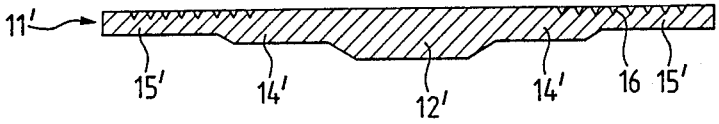
FIG. 2 shows a cross-section through a disk from which the fragmentation or splintering jacket depicted in FIG. 1 is fabricated.

The fragmentation or splintering jacket 11 is fabricated from a disk 11' which is illustrated in FIGS. 2 and 3 and indicated by dash-dotted lines in FIG. 1. In correspondence with the shape or configuration of the fragmentation or splintering jacket 11 to be produced, the disk 11' comprises an inner part or portion 12' having a thickness corresponding to the thickness of the base or bottom 12, an intermediate annular part or portion 14' having a thickness corresponding to the thickness of the rear or tail part or portion 14 of the sleeve-shaped projectile body 13, and an outer annular part or portion 15' having a thickness corresponding to the thickness of the front or head part or portion 15 of the sleeve-shaped projectile body 13. In this manner, the inner part or portion 12' is thicker than the intermediate annular part or portion 14' and, in turn, the latter is thicker than the outer annular part or portion 15'.

Figure 7:
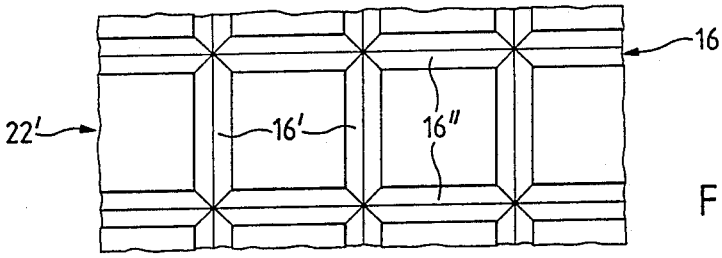
FIG. 7 shows a top plan view of the detail illustrated in FIG. 6.
Figure 6:
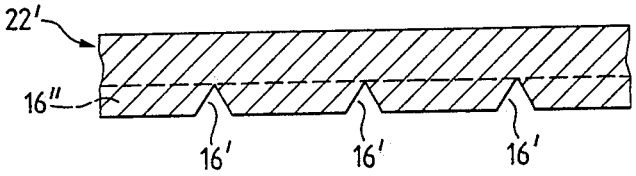
FIG. 6 shows, on an enlarged scale in relation to the illustration of FIG. 5, a detail of the cross-section through the disk depicted in FIG. 5.

One side of the disk 11' depicted in FIG. 2 is provided with grooves 16. The form or shape of these grooves 16 is shown on an enlarged scale in FIGS. 6 and 7. As depicted in FIG. 6, these grooves possess a substantially triangular or V-shaped cross-section. According to the top plan view of FIG. 7, there are provided lengthwise, i.e. annular grooves 16' and transverse, i.e. radial grooves 16''. The upper side of the disk 11' as depicted in FIG. 2 and comprising the grooves 16 constitutes the inner side or surface of the fragmentation or splintering jacket 11 after subjecting the disk 11' to a shaping operation in order to form the fragmentation or splintering jacket 11. Such shaping operation of the disk 11' is effected in conventional and known manner, particularly by, for example, deep drawing.

The projectile or shell 10 comprises a bursting or explosive charge 17 within the fragmentation or splintering jacket 11. This bursting or explosive charge 17 is detonated by means of a suitable tip or point or nose fuze 18 which is screwed into or threadably connected to an internal thread or tap 19 of the fragmentation or splintering jacket 11. A booster or booster charge 20 is located at the rear or tail end of the point or nose fuze 18 and projects into the interior of the bursting or explosive charge 17.

Figure 4:
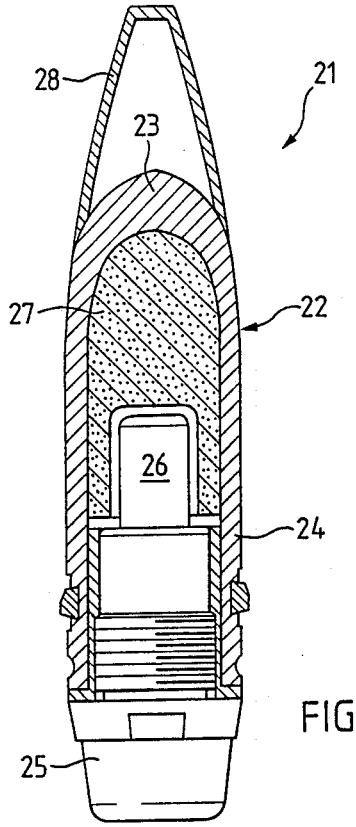
FIG. 4 shows a longitudinal sectional view through a projectile or shell comprising a base fuze or detonator and a fragmentation or splintering jacket produced according to a second exemplary embodiment of the inventive method.
Figure 5:
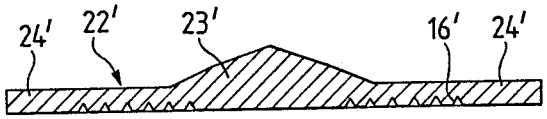
FIG. 5 shows a cross-section through a disk from which the fragmentation or splintering jacket depicted in FIG. 4 is fabricated.

In accordance with FIG. 4 a projectile or shell 21 likewise comprises a cup-shaped fragmentation or splintering jacket 22. This fragmentation or splintering jacket 22 possesses a tip or nose 23 which closes a sleeve-shaped projectile body 24 at a front or head portion thereof. This cup-shaped fragmentation or splintering jacket 22 is thicker at the tip or nose 23 than at the rear or tail end thereof. Furthermore, this fragmentation or splintering jacket 22 is likewise fabricated from a disk 22' which has a central part or portion 23' which forms the tip or nose 23 and has a correspondingly greater thickness. This disk 22' comprises at its lower side, as can be seen in FIG. 5, lengthwise, i.e. annular grooves 16' and transverse, i.e. radial grooves 16'' as described hereinbefore and depicted in FIGS. 6 and 7. A suitable base fuze or detonator 25, as shown in FIG. 4, is located at the rear or tail end and screwed into or threadably connected to the cup-shaped fragmentation or splintering jacket 22. This base fuze or detonator 25 comprises a booster or booster charge 26 which projects into the interior of a bursting or explosive charge 27 located within the cup-shaped fragmentation or splintering jacket 22.

Contrary to the first exemplary embodiment of the inventive method of producing the sleeve-shaped projectile body 13 illustrated in FIG. 1, the sleeve-shaped projectile body 24 produced according to the second exemplary embodiment of the inventive method, possesses substantially the same thickness in the front or head portion as well as in the rear or tail portion. Accordingly, the disk 22' is only subdivided into a relatively thicker central part or portion 23' and a relatively thinner outer annular part or portion 24'. In this second embodiment, the projectile or shell 21 containing the base fuze or detonator 25 instead of the point or nose fuze or detonator 18, requires a ballistic hood or cap 28. As depicted in FIG. 4, this ballistic hood or cap 28 is simply placed upon or fitted to the smooth surface of the cup-shaped fragmentation or splintering jacket 22.

Figure 8:
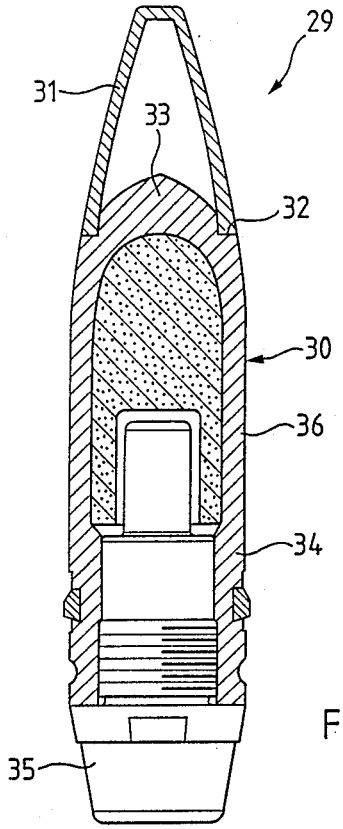
FIG. 8 shows a longitudinal sectional view through a modified projectile or shell comprising a base fuze or detonator and a fragmentation or splintering jacket produced according to the second exemplary embodiment of the inventive method.
Figure 9:
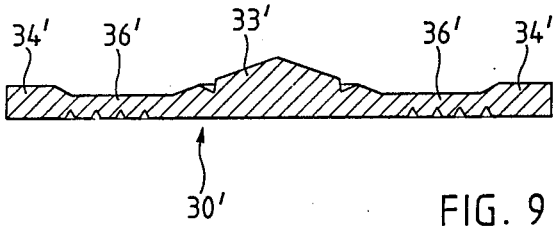
FIG. 9 shows a cross-section through a disk from which the fragmentation or splintering jacket depicted in FIG. 8 is fabricated.

According to FIGS. 8 and 9 a projectile or shell 29 comprises a cup-shaped fragmentation or splintering jacket 30. Contrary to the cup-shaped fragmentation or splintering jacket 22 shown in FIG. 4, a circumferential groove 32 is arranged at the cup-shaped fragmentation or splintering jacket 30 for mounting a ballistic hood or cap 31. The cup-shaped fragmentation or splintering jacket 30 comprises not only a comparatively substantially thicker tip or nose 33, but also a comparatively thicker sleeve-like rear or tail portion or section 34. Therebetween, there is located a relatively thinner intermediate portion or section 36. Accordingly, a disk 30' possesses a different cross-section as compared to the disks 11' and 22'. This disk 30' is subdivided into a relatively thicker inner part or portion 33', a relatively thinner intermediate annular part or portion 36' and a relatively thicker outer annular part or portion 34'.

Figure 10:
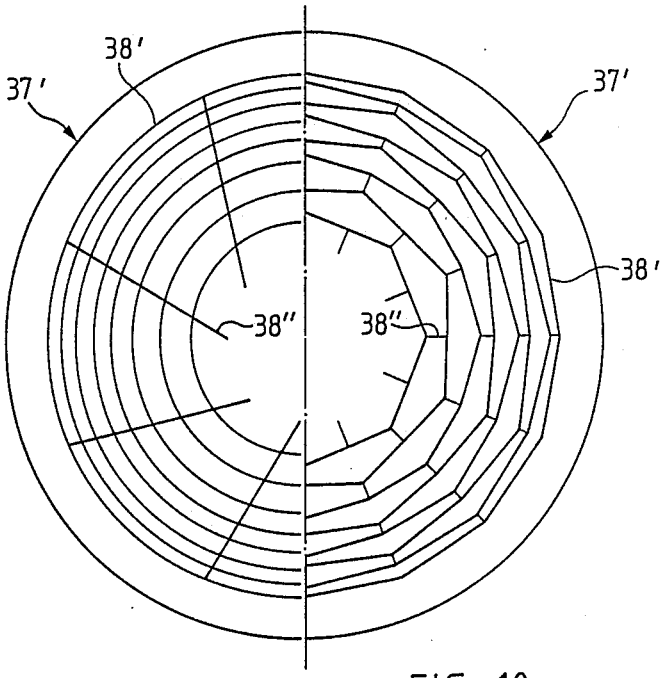
FIG. 10 shows, in a top plan view of a disk, different configurations of grooves defining reference fracture locations.

A disk 37' as depicted in FIG. 10, shows different patterns or configurations of grooves 38' and 38'' on the two sides of a central, dash-dotted dividing line. The patterns or configurations of these grooves 38' and 38'' are selected such that regular hexagons or quadrangles are respectively formed when the disk 37' is shaped into a cup-shaped fragmentation or splintering jacket.

The grooves 38'' which may extend in substantially radial direction or at a preselected inclination thereto, are preferably formed or impressed into the disk 37' to have a smaller depth than the substantially concentric annular grooves 38'. This has the advantage that there is obtained, by virtue of the different impressing depths of the grooves 38' and 38'', a uniform disintegration of the cup-shaped fragmentation or splintering jacket into fragments or splinters of the desired size.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of producing a fragmentation jacket for a projectile comprising within the fragmentation jacket an explosive charge which is detonated by a fuze, comprising the steps of:

producing a blank in the form of a disk;

impressing into the disk impressions defining reference fracture locations in the form of grooves;

said step of impressing into the disk impressions defining reference fracture locations in the form of grooves entailing the step of impressing into at least one side of the disk substantially concentric annular grooves and substantially radial grooves having a smaller preselected depth than that of said substantially concentric annular grooves;

subjecting the grooves-containing disk to a shaping operation, thereby forming a fragmentation jacket having a predeterminate configuration;

said step of producing said blank in the form of a disk entailing the step of producing a disk comprising a central portion, an intermediate annular portion and an outer annular portion having a different thicknesses relative to each other;

during said step of impressing into said disk said substantially concentric annular grooves and said substantially radial grooves having said smaller preselected depth than said substantially concentric annular grooves, impressing said substantially concentric annular grooves and said substantially radial grooves, at least into said intermediate annular portion of said disk; and said step of subjecting the grooves-containing disk to the shaping operation forming said fragmentation jacket entailing the step of forming a substantially cup-shaped fragmentation jacket having opposite end portions and a substantially cylindrical intermediate portion of different wall thicknesses which correspond to said different thicknesses of the portions of said disk and which define said predeterminate configuration of said fragmentation jacket and thereby forming, at least in an inner surface and at least in said substantially cylindrical intermediate portion, substantially lengthwise grooves corresponding to said substantially radial grooves of said disk and substantially concentric circumferential grooves corresponding to said substantially concentric annular grooves to said disk, wherein said lengthwise grooves have a smaller preselected depth than that of said circumferential grooves.

2. The method as defined in claim 1, wherein:

said step of impressing into the disk impressions defining reference fracture locations in the form of grooves entails impressing into the disk a pattern of hexagons.

3. The method as defined in claim 1, wherein:

said step of impressing into the disk impressions defining reference fracture locations in the form of grooves entails impressing into the disk a predetermined pattern; and during said step of subjecting the disk to the shaping operation, converting said predetermined pattern impressed into said disk into a regular pattern of a desired fragment configuration.

4. The method as defined in claim 3, wherein:

said step of converting said predetermined pattern impressed into said disk into said regular pattern of said desired fragment configuration entails forming, as said desired configuration, a regular pattern of regular hexagons.

5. The method as defined in claim 3, wherein:

said step of converting said predetermined pattern impressed into said disk into said regular pattern of said desired fragment configuration entails forming, as said desired configuration, a regular pattern of substantially identical quadrangles.

6. The method as defined in claim 1, wherein: said step of subjecting said disk to said shaping operation entails subjecting the disk to a deep drawing operation.

7. A method of producing a fragmentation jacket for a projectile comprising within the fragmentation jacket an explosive charge which is detonated by a fuze, comprising the steps of:

producing a blank in the form of a disk;

impressing into the disk impressions defining reference fracture locations in the form of grooves;

subjecting the disk to a shaping operation, thereby forming a fragmentation jacket having a predeterminate configuration;

said step of producing said blank in the form of a disk entailing the step of producing a disk comprising a central portion, an intermediate annular portion and an outer annular portion having different thicknesses relative to each other;

said step of forming said fragmentation jacket entailing the step of forming of cup-shaped fragmentation jacket having a closed nose portion, a substantially cylindrical intermediate portion of a predeterminate axial length and a fuze-receiving tale portion of different wall thicknesses which correspond to said different thicknesses of the central portion, the intermediate annular portion and the outer annular portion of said disk and which define said predeterminate configuration of said fragmentation jacket;

said step of impressing into said disk the impressions defining said reference fracture locations in the form of grooves, entailing the step of impressing, as said grooves, a predetermined pattern of grooves into one side of a preselected fraction of said intermediate annular portion of said disk;

said step of impressing said grooves into said one side of the preselected fraction of said intermediate annular portion of said disk including impressing substantially concentric annular grooves having a first preselected depth and substantially radial grooves having a second preselected depth different than said first preselected depth; and during said step of forming said cup-shaped fragmentation jacket, converting said predetermined pattern of grooves present in said one side of said preselected fraction of the intermediate annular portion of the disk, into said reference fracture locations along a preselected fraction of said predeterminate axial length in an inner surface of said substantially cylindrical intermediate portion of said cup-shaped fragmentation jacket, and thereby producing a regular pattern of a desired fragment configuration.

8. The method as defined in claim 7, wherein:

said step of impressing said grooves into said one side of the preselected fraction of said intermediate annular portion of said disk includes impressing substantially radial grooves having a smaller preselected depth than that of said substantially concentric annular grooves.

9. The method as defined in claim 7, wherein:

said step of impressing said grooves into said one side of the preselected fraction of said intermediate annular portion of said disk entails impressing into the disk a pattern of hexagons.

10. The method as defined in claim 7, wherein:

said step of producing said regular pattern of said desired fragment configuration entails forming, as said desired fragment configuration, a regular pattern of regular hexagons.

11. The method as defined in claim 7, wherein:

said step of producing said regular pattern of said desired fragment configuration entails forming, as said desired fragment configuration, a regular pattern of substantially identical quadrangles.

12. The method as defined in claim 7, wherein:

said step of forming said cup-shaped fragmentation jacket entails subjecting the disk to a deep drawing operation.

* * * * *